US005197684A

United States Patent [19]

Bihlet et al.

[11] Patent Number: 5,197,684

[45] Date of Patent: Mar. 30, 1993

[54] DEVICE FOR TEARING-UP AND STOKING STRAW

[75] Inventors: Klaus Bihlet, Gjerlev J.; Jorgen Pedersen, Mariager, both of Denmark

[73] Assignee: Licencia Holding S.A., Luxembourg

[21] Appl. No.: 659,021

[22] Filed: Feb. 21, 1991

[30] Foreign Application Priority Data

Feb. 21, 1990 [DK] Denmark ..... 0462/90

[51] Int. Cl.[5] ..... B02C 19/12

[52] U.S. Cl. ..... 241/283; 110/109; 110/196; 241/600; 241/605

[58] Field of Search ..... 241/283, 600, 101 A; 110/109, 222, 290, 289, 293, 101 A, 196, 197; 19/81, 145.5

[56] References Cited

U.S. PATENT DOCUMENTS

| | | | |
|---|---|---|---|
| 2,646,913 | 7/1953 | Goldberg et al. | 241/101 A X |
| 3,855,950 | 12/1974 | Hughes et al. | 110/109 X |
| 4,516,734 | 5/1985 | Pierret et al. | 241/283 |
| 4,796,544 | 1/1989 | Overgaard . | |
| 5,009,171 | 4/1991 | Martin et al. | 110/109 |

FOREIGN PATENT DOCUMENTS

| | | | |
|---|---|---|---|
| 134331 | 10/1976 | Denmark . | |
| 2003/81 | 6/1981 | Denmark . | |
| 4465/86 | 7/1986 | Denmark . | |
| 0117297 | 9/1984 | European Pat. Off. . | |
| 3302380 | 7/1984 | Fed. Rep. of Germany | 110/196 |

*Primary Examiner*—Mark Rosenbaum
*Attorney, Agent, or Firm*—Lee, Mann, Smith, McWilliams, Sweeney & Ohlson

[57] ABSTRACT

A device for tearing-up and stoking straw into a burner unit. A reciprocating slide is provided under a magazine shaft for straw bales, the slide having mutually staggered teeth on its upper side in a forward part of the slide and elongated fins extending in the direction of movement of the slide in a rear part. The part closest to the stoking channel constitutes a piston means for the conveyance and compression of comminuted straw. The straw is torn-up during the initial advance movement of the slide towards the channel because the teeth are in engagement with the bottom of the lowermost bale, whereas the bale is upheld by the teeth and the fins during the return movement of the slide. The piston means ensures that the shredded straw is pushed into a stoking channel for the combustion chamber of a boiler. Very compressed straw bales are thereby very uniformly comminuted and compressed before being fed into a burner unit.

8 Claims, 2 Drawing Sheets 16
11
17
17
17
20
6
10
4
2
5
2
8
7
3
2
3
5
5
8
9
12 8 9
12
2
7
7
12
18
14
13
15

DEVICE FOR TEARING-UP AND STOKING STRAW

BACKGROUND OF THE INVENTION

The invention concerns a device for tearing-up and stoking straw into a combustion chamber and comprising an essentially vertical magazine shaft for containing a number of straw bales under which shaft an essentially horizontal slide with teeth is movable from one position vertically below the shaft and into a stoking channel and back again.

Devices of this sort are used especially in connection with straw-burning boilers for feeding the combustion chamber of the boiler with torn-up straw from straw-bales through a stoking channel.

From DK patent publication no. 134.331 and DK patent application no. 2003/81 there are disclosed devices where the cutting-off process is performed by means of a cutting edge, which by the advance of the slide cuts a slice off the straw bale and pushes it forward in the stoking channel.

By the known art there is not produced comminuted straw, but rather separate blocks of straw cut off the bales. This does not give an even and continuous feeding and the combustion of the straw is also poor because of the lump-like straw blocks that are highly compressed due to the baling process. Also, a large amount of power is needed to convey the cutting edge.

To reduce these disadvantages a tearing-up device is disclosed in DK patent application no. 4465/86, said device comprising sawtooth-shaped knives which during their reciprocating movement tear off straw which falls into an underlying hopper and an aggregate for stoking the straw into the combustion chamber. The knives are shaped as mutually parallel saw blades working on the end surface of the straw bale with a sawing motion. This does not give a uniform tearing-off effect and therefore the efficiency is not particularly high on account of this saw-like movement. Thus the power consumption is relatively large in proportion to the quantity of shredded straw.

BRIEF SUMMARY OF THE INVENTION

An object of the present invention is obviate or reduce the disadvantages implied by the previous devices. Especially it is an object to improve the tearing-off process by making it more effective in relation to the power consumed while at the same time the torn-off and conveyed straw has a homogeneous consistence regarding to its structure and degree of compression.

This is obtained by a device as mentioned in the introduction and where the slide is provided with teeth with single upward-facing elements mounted on the slide, the teeth being mutually staggered in the direction of movement of the slide.

Furnishing the slide with such staggered tooth-elements there is achieved a hitherto unknown high efficiency because of the evenly distributed tearing-up over the entire end surface of the bale. Add to this that the straw bale because of its weight will rest against the slide thereby obtaining a full tearing-up effect from the very start of the forward movement of the teeth towards the stoking channel.

In this way all the teeth will be active during their contact with the straw bale so that the efficiency will be as high as possible. Furthermore, a very uniformly torn-up straw material is attained ensuring a uniformly good combustion.

In addition, the amount of mechanical equipment is reduced as the movements of the slide also push the torn-off straw directly into the stoking channel and eventually into the combustion chamber.

When using the device according to the invention, the tearing-off can be performed in a continuous manner, since the slide may be started and stopped at any place during its reciprocating cycle without impairing the shredding process. This makes it possible to vary the flow of straw according to the fuel demand, which is useful for example in a district heating plant.

According to an embodiment of the invention, the lower edge of the shaft close to the stoking channel may be provided with stops projecting down towards the slide and in such a way that the teeth can pass between the stops. The stops ensure that the torn-off straw will only be carried forward into the stoking channel and not be withdrawn by the return movement of the knives.

By designing the device according to the invention, where the stops are individually pivotably connected to an axle, so that the stops during the motion of the slide towards the stoking channel may be swung in the direction of motion and upwards, the straw may be conveyed unhindered into the stoking channel by the leading edge of the slide as well as by the knives, whereas the return movement of the slide will cause the stops to swing downwardly thereby retaining the torn-off straw in the stoking channel.

In another preferred embodiment according to the invention, the slide is provided with a planar extension so that the straw bale always will rest on the upper side of the slide, counteracting the tendency of the straw to be brought along with the return movement of the slide.

In a further preferred embodiment of the device according to the invention the device is provided with upstanding, elongated fins on the part of the slide farther from the stoking channel and extending in the direction of motion. In this way the straw bale will be kept raised during the return of the slide and not be lowered until the teeth are under the straw bale.

In a still further embodiment of the device according to the invention, in the part of the lower edge of the shaft farther from the stoking channel there is provided second retaining means in the shape of a downward projecting piece of plate traversing the direction of movement of the slide. The plate has vertical open slits dimensioned and positioned so as to allow the passage of the fins. Thus, comminuted straw may be retained in the shaft during the return movement of the slide.

BRIEF DESCRIPTION OF THE DRAWINGS

An embodiment of the device according to the invention will described below with reference to the drawing, where.

DESCRIPTION OF A PREFERRED EMBODIMENT

Figure 1:
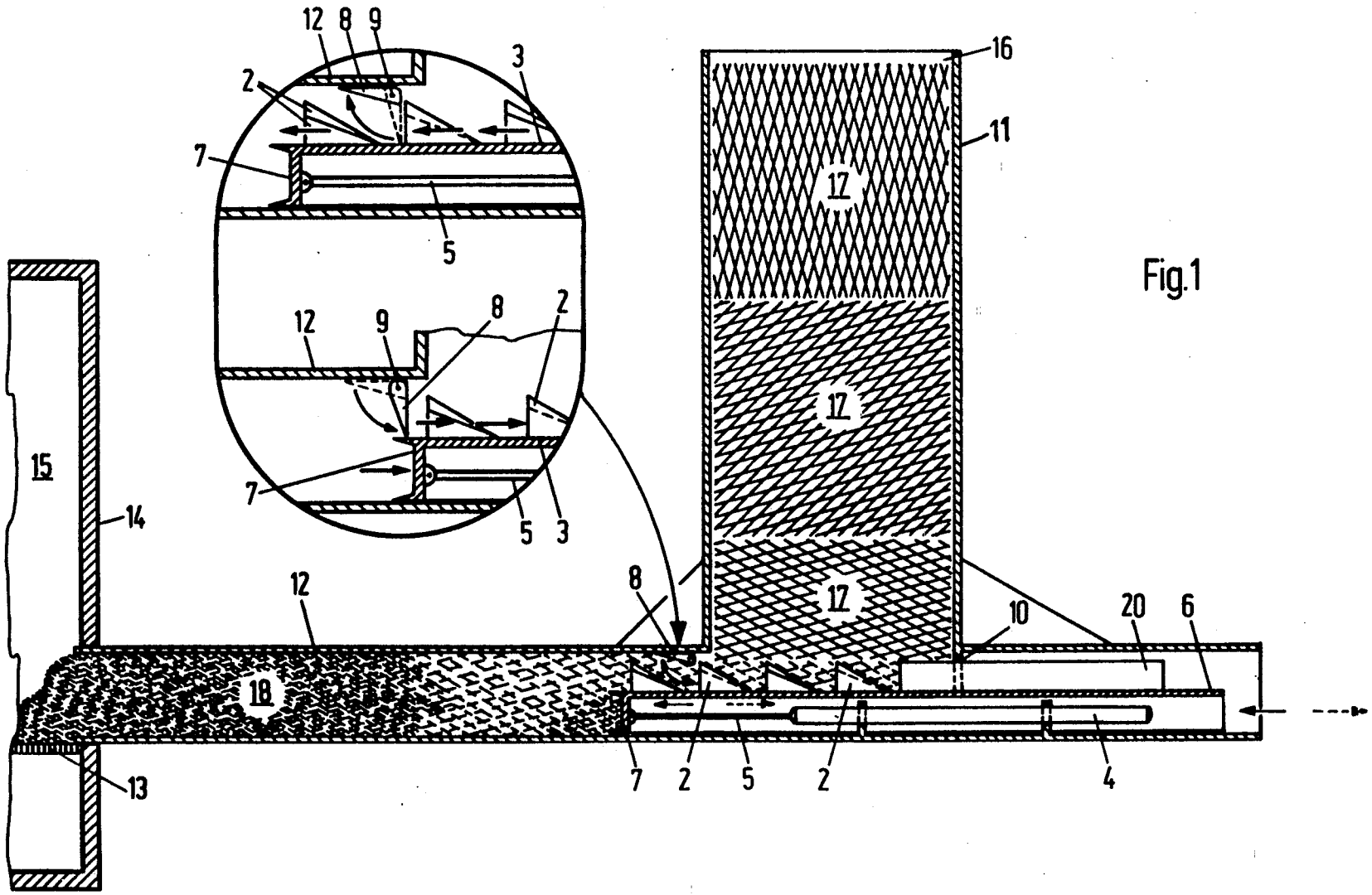
FIG. 1 is a sectional view of a device according to the invention, where the slide is moving forward, and with an enlarged view comprising two detailed views of the foremost stops respectively during the advance of the slide and during its return.

FIG. 1 shows a preferred embodiment of the device according to the invention comprising a straw bale magazine 11, having a shaft 16 in which one or more straw bales 17 can be placed. The device is arranged to feed comminuted straw 18 through a stoking channel 12 into a combustion chamber 15 of a boiler 14.

Figure 2:
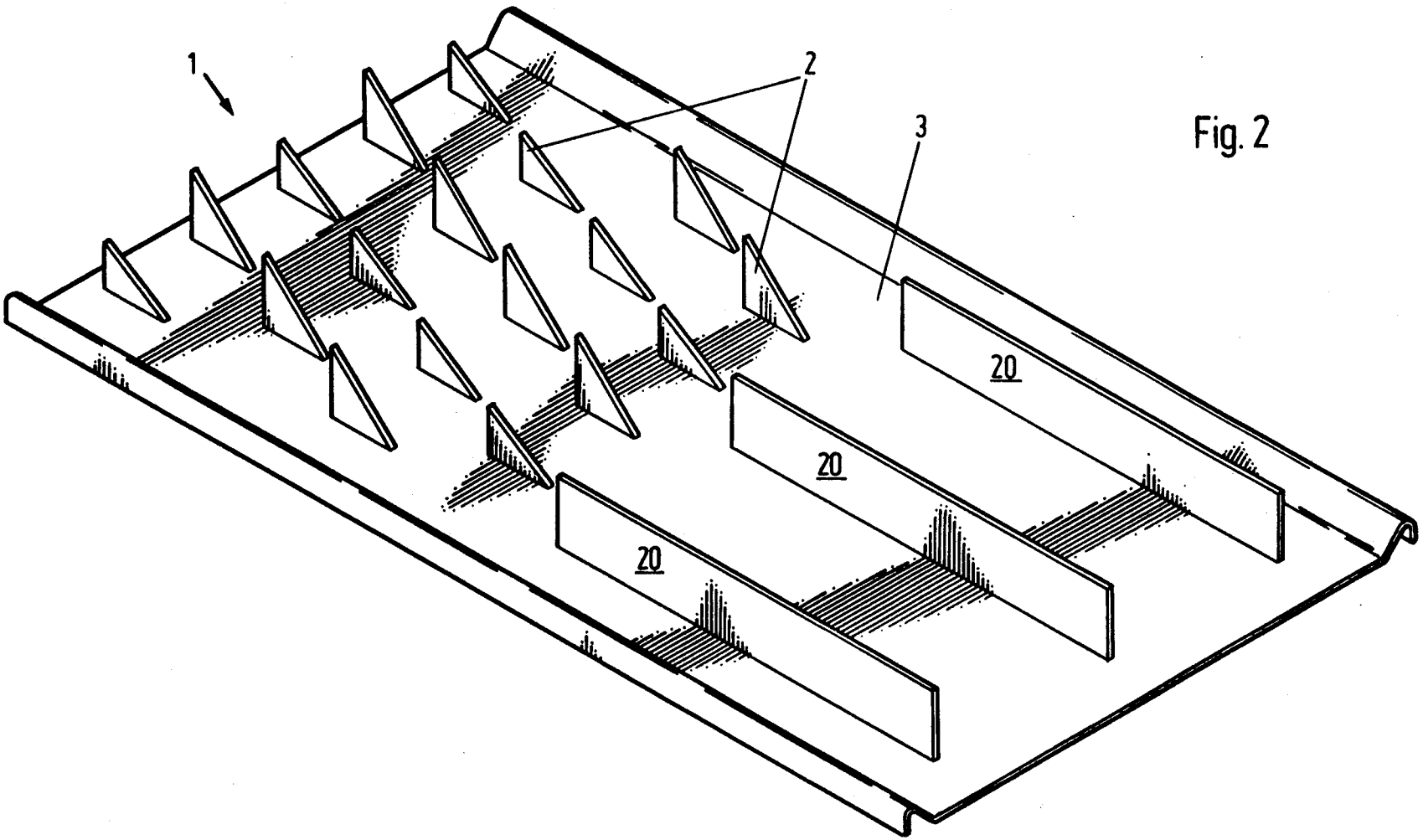
FIG. 2 shows the slide with teeth and fins seen in an elevated perspective view.

The bottom of the shaft 16 has a mouth above the shredding unit, which comprises a slide I with an upper plate 3 forming the top plate of the slide, as best shown in FIG. 2.

The plate 3 is designed as a rectangular frame to form a box, the front edge of which forms a piston means 7.

A hydraulic cylinder 4 is mounted under the box attached to the stationary part of the shredder, while the piston rod 5 of the cylinder 4 is attached to the front piston means 7 of the slide 1.

Shredding teeth 2 are welded onto the upper side of the plate 3 which, as is illustrated especially in FIG. 2, are mutually staggered so that the teeth 2 will stroke the whole end surface of the straw bale 17 across its entire width as the slide 1 advances towards the stoking channel 12.

On the rear part 6 of the slide I and welded to the plate 3 are provided several elongated, upstanding fins 20 which are mounted parallel to the direction of movement of the slide 1, the fins 20 having a height above the plate 3 approximately the same as the teeth 2.

The teeth 2 consist of rectangular triangle elements, e.g. of cut-out steel plate welded to the plate 3, where one vertical leg of the triangle forms the off-tearing edge facing the stoking channel 12.

Below the shaft 16 at the side closest to the stoking channel, as appears from the enlarged detail view, there are mounted a number of stops 8 individually suspended on a horizontal axle 9. By this mounting the stops can be swung forward and upwardly, singly or jointly, as the slide is advancing towards the channel 12, as seen in the upper detail of FIG. 1, and can be swung down into the vertical position when the slide returns, as seen in the lower detail.

At the bottom edge of the shaft 16 at the side farther from the channel 12 there is mounted a plate 10 with vertical slots in which the fins 20 can slide, the plate 10 acting also as retaining means to retain the straw in the shaft 16.

The distance between adjacent stops 8 is conformed to the width of the tooth elements 2, so that the teeth 2 and thus the slide 1 can be moved forward and backward between the stops 8 from a position where the foremost teeth 2 are under the straw bale 17 to a position where the rearmost edge of the slide is close to the backside of the plate 10.

When a straw bale 17 is put into the magazine 11 it will fall down and rest against the knives 2 and the plate 3. By activation of the cylinder 4 to start a reciprocating working cycle the piston rod 5 will cause the slide 1 to reciprocate.

During the advance movement of the slide 1 the knives 2 will partly cut any binder twine about the bale 17 and partly move forward through the bottom layer of the bale 17. By this motion the straw will be torn up by the knives 2 and be carried forward under the stops 8, which will be swung upwardly by the torn-off straw.

As the tearing-up progresses by the reciprocating movement of the slide 1, the torn-off straw 18 will be pressed forward in the stoking channel 12 by the piston means 7, where the straw 18, according to the form of the channel, will be compressed and fed into the Combustion chamber 15 e.g. onto a grate 13 in the boiler 14.

It will be noticed that the straw bale 17 during the return of the slide first will be kept up by the fin 20 and next by the teeth 2 which due to their shape easily can be drawn back under the the straw bale. When the slide is pushed forward, the straw bale 17 will sink down onto the slide, so that the teeth 2 at once will touch the straw which consequently will be torn up in a hitherto unknown effective way from the very start of the movement.

Through a suitable operation of the hydraulic cylinder 4 and depending on the needed effect of the boiler, a very high useful power is achieved with relatively low power consumption by the cylinder 4.

The device according to the invention may be varied in a number of ways without departing of the scope of the claims.

What we claim is:

1. A device for tearing up and stoking straw into a combustion chamber, comprising an essentially vertical magazine shaft for straw bales, an essentially horizontal slide means located below and in communication with said shaft, said slide means including means for linear reciprocating motion from a first position vertically below the shaft to a second position into a stoking channel for conveyance of shredded straw and back again, the slide means including tooth means having single upward-facing elements mounted on the slide means, the tooth means being mutually staggered in the direction of movement of the slide means, and including first retaining means at a lower edge of the shaft closest to the stoking channel in the shape of stops projecting down towards the slide means and located such that the tooth means can pass between the stops.

2. A device according to claim 1, wherein the stops are individually pivotably connected to an axle, so that during motion of the slide means towards the stoking channel the stops may be swung in the direction of said motion and upwards.

3. A device according to claim 1, wherein the slide means is positioned and dimensioned in such a way that it extends under the shaft in both said positions of its reciprocating movement.

4. A device for tearing up and stoking straw into a combustion chamber, comprising an essentially vertical magazine shaft for straw bales, an essentially horizontal slide means located below and in communication with said shaft, said slide means including means for linear reciprocating motion from a first position vertically below the shaft to a second position into a stoking channel for conveyance of shredded straw and back again, the slide means including tooth means having single upward-facing elements mounted on the slide means, the tooth means being mutually staggered in the direction of movement of the slide means, and in which a portion of the slide means farthest from the stoking channel is provided with a series of upwardly projecting fins extending in the direction of movement of the slide means.

5. A device according to claim 4, including second retaining means at a lower edge of the shaft farthest from the stoking channel, said second retaining means being in the shape of a downwardly projecting plate traversing the direction of movement of the slide means, the plate having vertical slits dimensioned and positioned as to allow the passage of the fins.

6. A device for tearing up and stoking straw into a combustion chamber and comprising an essentially vertical magazine shaft for straw bales, an essentially horizontal slide means located below and in communication with said shaft, said slide means including means for linear reciprocating motion from a first position vertically below the shaft to a second position into a stoking channel for conveyance of shredded straw and back again, the slide means comprising tooth means having single upwardfacing elements mounted on the slide means, the tooth means being mutually staggered in the direction of movement of the slide, first retaining means being located at a lower edge of the shaft closest the stoking channel, said first retaining means being in the shape of stops projecting down towards the slide means and being located such that the tooth means can pass between the stops, in which the stops are individually pivotably connected to an axle, so that during motion of the slide means towards the stoking channel the stops may be swung in the direction of said motion and upwards, and in which the slide means is positioned and dimensioned in such a way that it extends under the shaft in both said positions of its reciprocating movement.

7. A device according to claim 6, wherein a portion of the slide means farthest from the stoking channel is provided with a series of upwardly projecting fins extending in the direction of movement of the slide means.

8. A device according to claim 7, including second retaining means at a lower edge of the shaft farthest from the stoking channel, said second retaining means being in the shape of a downwardly projecting plate traversing the direction of movement of the slide means, the plate having vertical slits dimensioned and positioned as to allow the passage of the fins.

* * * * *